United States Patent [19]

Yoshimura et al.

[11] 3,993,471

[45] Nov. 23, 1976

[54] METHOD FOR MANUFACTURE OF REDUCED PELLETS

[75] Inventors: Ryoichi Yoshimura, Yokohama; Takashi Shoji, Chichibu, both of Japan

[73] Assignee: Showa Denko Kabushiki Kaisha, Tokyo, Japan

[22] Filed: Sept. 5, 1975

[21] Appl. No.: 610,745

[30] Foreign Application Priority Data

Sept. 9, 1974 Japan ..... 49-103016

[52] U.S. Cl. ..... 75/3

[51] Int. Cl.[2] ..... C22B 1/08

[58] Field of Search ..... 75/3–5

[56] References Cited

UNITED STATES PATENTS

| | | | |
|---|---|---|---|
| 2,711,951 | 6/1955 | West | 75/3 |
| 2,864,687 | 12/1958 | Myron | 75/3 |

*Primary Examiner*—Peter D. Rosenberg

*Attorney, Agent, or Firm*—Oblon, Fisher, Spivak, McClelland & Maier

[57] ABSTRACT

Reduced pellets are manufactured by mixing a powdered raw metallurgical ore such as of iron, chromium or manganese with a carbonaceous reducing material obtained by heat-treating anthracite, at temperatures between 600° C and 1000° C and subsequently pulverizing the heat-treated anthracite, pelletizing the resultant mixture and thereafter roasting the pellets.

5 Claims, 2 Drawing Figures

METHOD FOR MANUFACTURE OF REDUCED PELLETS

BACKGROUND OF THE INVENTION

This invention relates to a method for the manufacture of reduced pellets, which method comprises heat-treating anthracite at temperatures between 600° C and 1000° C, pulverizing the heat-treated anthracite to give rise to a carbonaceous reducing material, mixing the carbonaceous reducing material with a powdered raw metallurgical ore such as of iron, chromium or manganese, pelletizing the resultant mixture and thereafter roasting the pellets.

It has already been known to the art to obtain reduced pellets by combining a powdered ore, a powdered carbonaceous reducing material and a binder, pelletizing the resultant mixture and roasting the pellets in a furnace such as a rotary kiln. In the case of reduced pellets which are produced from iron ore as the starting material, they are used in their unmodified form as reduced iron. In the case of reduced pellets produced by using either chromium ore or manganese ore as the starting material, the reduced pellets are further refined in an electrical furnace to produce a corresponding ferroalloy. The primary objects of the production of reduced pellets from such a mineral ore are as follows. In the first place, a raw mineral ore which is in a powdery form, does not provide convenience of handling when used as a raw material for refining, whereas the same ore provides convenience of handling when it is used in a pelletized form. Since the pellets are already in a partially reduced state, the additional refining to be carried out in an electric furnace enjoys enhanced productivity. Further, in the production of a ferroalloy, the refining is generally effected by charging the electric furnace with the raw ore in conjunction with carbon. In the refining of this form, there is entailed a heavy consumption of expensive electric power. If, in this case, the refining is carried out by preparing reduced pellets in advance and thereafter charging the electric furnace with these reduced pellets, then the overall cost of energy consumption can be lowered because the pellets have already been roasted to be reduced by the combustion of heavy oil or the like and, therefore, the electric power actually consumed in the electric furnace is less than would otherwise be consumed, the saving being ascribable to the use of less expensive heavy oil in said reduction.

In the preparation of reduced pellets, coke from coal is generally used as the carbonaceous reducing material. For use in the preparation of reduced pellets, the carbonaceous reducing material is required to be in a finely ground state. Since the coke from coal has extremely poor grindability, the work of finely grinding this coke requires enormous power. The lining parts of the grinding machine, for example a ball mill, in which the coke is treated therefore experience heavy wear. Moreover, in the machinery employed indispensably in handling the coke from coal, accelerated wear occurs such as on parts of the machines in the conveyor system, rabbit dryer vanes in the drying system, etc. Thus, the work of size reduction turns out to be guite costly.

Anthracite is also known as a carbonaceous reducing material usable in the preparation of reduced pellets. For the purpose of this use, however, anthracite has its merits and demerits. As for merits, anthracite enjoys excellent grindability and avoids causing accelerated wear on the machinery. Table 1 shows the properties of coke from coal and of anthracite.

Table 1.

| Item | Properties of coke from coal and anthracite: Coke from coal | Anthracite A (produced in South Africa) | Anthracite B (produced in China) |
|---|---|---|---|
| 1 Fixed carbon | 88 wt% | 76 wt% | 83 wt% |
| 2 Volatile matter | 2 | 12 | 9 |
| 3 Ash content | 10 | 12 | 8 |
| 4 Fuel ratio | 44.0 | 6.3 | 9.2 |
| 5 Grindability(A) | 82 KWH/t | 22 KWH/t | 33 KWH/t |
| 6 Wear (B) | 2.0% | 0.08% | 0.5% |

The term "fuel ratio" given in the foregoing table means the quotient obtained by dividing the content (% by weight) of fixed carbon by the content (% by weight) of volatile matter. The grindability (A) represents the value of work index which is defined by Fred C. Bond in "British Chemical Engineering" (June 1961), 6 p. 378 and which is also defined in "Testing Method of Grinding Work Index," M 400, 1969 of Japanese Industrial Standards. It indicates the degree of grindability of a given carbonaceous reducing material. The value $W_i$ was obtained by grinding a fraction of a 700-ml sample in a small test mill measuring 305mm in diameter and 305mm in height and operated at a revolution number of 70rpm, sifting the resultant powder with a sieve of 149 $\mu$m ($P_1$) to have the powder divided into a stopped portion remaining unpassed on the sieve and a passed portion collecting under the sieve, adding another fraction of said sample in the same amount as that of the passed portion to the stopped portion on the sieve, repeating the sifting-adding step until the passed portion obtained under the sieve reached a constant weight and performing a calculation on the found weight in accordance with the following formula:

$$W_i = \frac{44.5}{(P_1)^{0.23} G_{bp}^{0.82} \left( \frac{10}{\sqrt{P_{80}}} - \frac{10}{\sqrt{F_{80}}} \right)}$$

wherein, $P_1$ denotes the mesh size ($\mu$m) of the sieve used in the test grinding $G_{bp}$ denotes the net ground weight (in grams) per the one rotation of the test mill in the grinding test mill, $F_{80}$ denotes the particle size of 80% pass (in $\mu$m) of the sample and $P_{80}$ denotes the particle size of 80% pass (in $\mu$m) of the ground product.

B denotes the wear of the carbonaceous reducing material, which was obtained as the result of the wear test described herein below. In a bed of a given carbonaceous reducing material packed in the form of a cylinder measuring 100mm in depth and 220mm in inside diameter, four test pieces of mild steel each weighing about 140g and measuring 90mm × 10.2mm Diam. were fixed in position in such a way that they would be exposed to uniform contact with the particles of carbonaceous reducing material within the bed and the cylindrical container was rotated at the rate of 1500rpm for 3 hours. At the end of the rotation, the test pieces were weighed to find loss of weight. And the found loss of weight was noted in terms of percentage. The value thus obtained serves as a criterion for estimation of the extent to which said carbonaceous reducing material would cause wear on the machinery in use.

In Table 1, it is seen that anthracite has different properties of grindability (A) and wear (B) from those of coke from coal. To be specific, the two grades of anthracite showed decidedly lower values of KWH per ton and far smaller percentages of wear than those of the coke, indicating that the substance anthracite possesses properties desirable for use as the material for reduced pellets. When reduced pellets are to be prepared by using anthracite as the raw material, however, there inevitably ensues a disadvantage that the formed pellets are disintegrated in the course of roasting or, if they fortunately escape this disintegration, they suffer from deficient tenacity. The main reason for this disadvantage is that the volatile component of anthracite escapes and the anthracite itself expands or shrinks while the anthracite is exposed to intense heat and, consequently, the formed pellets fail to retain their strength during or after the roasting. This disadvantage manifests itself conspicuously when the anthracite is of a type having a relatively low fuel ratio of from about 4 to 10. No technique has yet been established for the production of reduced pellets from the mixture of anthracite having such a low fuel ratio as shown in Table 1.

A main object of the present invention is to provide a method for the manufacture of reduced pellets by use of anthracite having a low fuel ratio without entailing heavy consumption of power such as in the operation of said reduction and without involving any accelerated wear of the equipment and machinery used for the production.

Another object of the present invention is to provide a method for the manufacture of reduced pellets by use of anthracite having a low fuel ratio, said reduced pellets being such that the formed pellets will not disintegrate while they are being roasted for the purpose of reduction or the formed pellets enjoy high strength.

BRIEF SUMMARY OF THE INVENTION

According to the present invention, reduced pellets are manufactured by heat-treating anthracite of a type having a fuel ratio of not less than 4 and not more than 10 at temperatures between 400° C and 1000° C, pulverizing the heat-treated anthracite, mixing the resultant powder with a powdered mineral ore, pelletizing the mixture in conjunction with a binder added thereto and roasting the pellets.

The reduced pellets produced by using an iron ore as the mineral ore material can be used without any further modification as reduced iron. When they are produced by using a manganese ore or chromium ore as the starting mineral ore material, the reduced pellets can be used for the production of refined manganese or chromium.

DETAILED DESCRIPTION OF THE INVENTION

The inventors made a study in search for a method for the manufacture of reduced pellets which, as indicated in Table 1 above, retain the desirable properties of anthracite for use as a carbonaceous reducing material in the production of reduced pellets and which avoid being disintegrated in the course of roasting and exhibit high pellet strength after the step of roasting. They have consequently accomplished the present invention.

Figure 1:
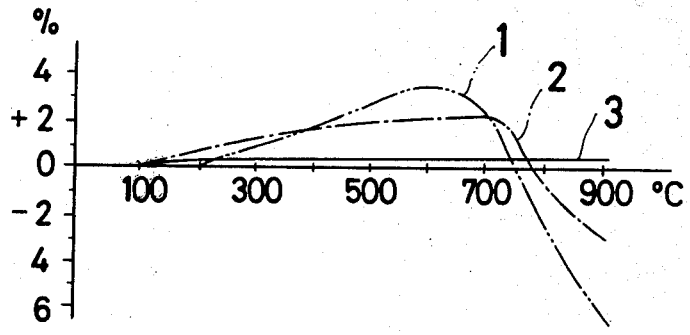
FIG. 1 is a diagram showing the coefficient of expansion of a carbonaceous reducing material as a function of the heating temperature.

The inventors conducted an experiment on the behaviors of the various carbonaceous reducing materials shown in Table 1 with respect to expansion and shrinkage at varying temperatures. The results were as shown in FIG. 1. In this experiment, blocks of said carbonaceous reducing materials in the form of cubes of 25mm were heated in an inert atmosphere to successively elevated temperatures and, in the meantime, they were measured at varying levels of temperature to find linear expansion coefficients by comparing the found volumes of the cubes with the original volumes.

In FIG. 1, the vertical axis is graduated for linear expansion coefficient and the horizontal axis for elevated temperature. The expansion observed in the neighborhood of 600° C is that of the volatile component itself and the sudden shrinkage observed above the level of 700° C is ascribed to the rearrangement of carbon atoms resulting from the escape of the volatile component. For use in the preparation of reduced pellets, the carbonaceous reducing material is desired to show a mild behavior of expansion or shrinkage when it is exposed to appreciably changing heat. In FIG. 1, Curve 1 represents the data obtained of anthracite A, Curve 2 of anthracite B and Curve 3 of coke from coal respectively. The linear expansion coefficient is seen to have remained substantially unchanged in the coke from coal and to have continued to rise to the neighborhood of 600° C to 700° C and then drop off suddenly near 700° C to 800° C in the two types of anthracite. Thus, FIG. 1 suggests that anthracite shows a conspicuous change in expansion coefficient with change of temperature as compared with coke from coal.

Figure 2:
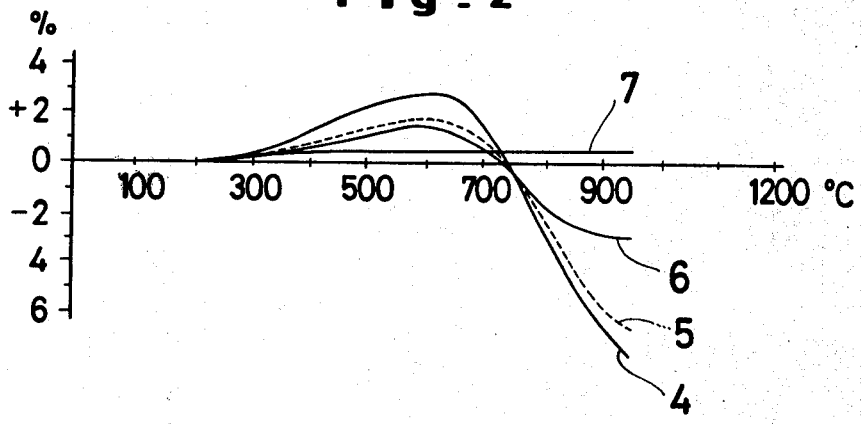
FIG. 2 is a diagram showing the coefficients of expansion of unheated anthracite and of heated anthracite.

Then, a carbonaceous reducing agent obtained by heating anthracite A was similarly molded and tested likewise for linear expansion coefficient. The results are shown in FIG. 2. In this diagram, Curve 4 represents the data obtained of a portion of anthracite which was not given said heat treatment and Curves 5, 6 and 7 represent the data obtained of portions of anthracite which were heated at 400° C, 600° C and 1000° C respectively for 60 minutes. The vertical axis is graduated for linear expansion coefficient and the horizontal axis for temperature of heating similarly to those in FIG. 1.

From FIG. 2, it is noted that the linear expansion coefficient for the portion of anthracite treated at 400° C is little different from that for the untreated portion. The linear expansion coefficients decrease in the order in which the temperatures of heating increase to 600° C, 900° C and 1000° C. At 1000° C, it is virtually the same as that of coke from coal. In an experiment the inventors ascertained that the linear expansion coefficient literally levels off at 1000° C. This indicates that from the standpoint of economy of heat, the temperaure of heating should be limited to 1000° C. Furthermore, the anthracite has its grindability degraded when it is heated at a temperature exceeding 1000° C. Also from this point of view, it is desirable that the heating of anthracite not exceed 1000° C.

From the results of tests described above, it is seen that when reduced pellets are manufactured by using as the carbonaceous reducing material the anthracite which has been heat-treated at temperatures between 600° C and 1000° C, the formed pellets experience no disintegration in the course of roasting and the reduced pellets enjoy high pellet strength. The heating time is selected in a suitable range, depending on the fuel ratio of the particular type of anthracite in use and the temperature of heating.

Table 2 given below shows typical combinations of fuel ratio, heating time and lowest temperature of heating needed for anthracite to become a carbonaceous reducing material suitable for the production of reduced pellets.

Table 2.

| Heating temperature | Heating time (in minutes) Fuel ratio 4 | 6 | 10 |
|---|---|---|---|
| 600° C | 90 | 80 | 60 |
| 1000° C | 60 | 50 | 40 |

The lengths of heating time indicated in the table above are the minimum allowed for the indicated conditions. The longest allowable heating time is two hours.

The portions of anthracite heat-treated under the conditions indicated in the preceding table were compared with the portion of the same anthracite which had not undergone this heat treatment to confirm that in spite of the heat treatment, the desirable properties of anthracite for the purpose of carbonaceous reducing material, namely, grindability (A) and wear (B) indicated in Table 1, were retained undegraded by the heat-treated portions. The results are shown in Table 3.

Table 3

| Temperature of treatment (° C) | 400 | | 600 | | 1000 | | 1200 | |
|---|---|---|---|---|---|---|---|---|
| Fuel ratio of anthracite | 6.3 | 9.2 | 6.3 | 9.2 | 6.3 | 9.2 | 6.3 | 9.2 |
| A (grindability in KWH/t | 25 | 33 | 46 | 49 | 36 | 40 | 63 | 68 |
| B (Wear in %) | 0.2 | 0.4 | 0.9 | 1.3 | 1.5 | 2.0 | 4.8 | 5.2 |

It is plain from this table that the value of B (criterion for estimation of the extent of wear on machinery to be used), increases with the increasing temperature of heat treatment and that at 1200° C the rate of increase is conspicuous as compared with the increase at temperatures up to 1000° C. Although the relation between A (grindability) and the temperature of heat treatment is not simple, the values of A for the temperatures up to 1000° C are considerably smaller than those for 1200° C. This suggests that the portions of anthracite heat-treated at temperatures up to 1000° C have desirable grindability. The data of Table 3, therefore, suggest it desirable to limit the temperature of heat treatment to 1000° C. According to the description given herein above with respect to the linear expansion coefficient and its effects, the heat treatment is desired to be performed at temperatures of not less than 600° C in order for the anthracite to become a carbonaceous reducing material suitable for the preparation of reduced pellets. All considered, therefore, the temperature of heating is desired to range between 600° C and 1000° C.

As is evident from the foregoing description, when reduced pellets are manufactured by using the anthracite heat-treated at temperatures in the range of from 600° C to 1000° C, the heat-treated anthracite yields only little to expansion or shrinkage, namely, it shows a small linear expansion coefficient. The formed pellets, therefore, are not disintegrated in the course of manufacture and the finally produced reduced pellets enjoy high pellet strength. Further, the anthracite heat-treated in the temperature range specified above shows advantageous grindability in the course of pelletizing and possible wear of the machinery used for the pellet preparation is very slight.

Now, the method by which reduced pellets are produced from a mineral ore and a carbonaceous reducing material will be described.

A mineral ore such as iron ore, chromium ore manganese ore and the anthracite which has been heat-treated in advance at temperatures of 600° C to 1000° C as described above are pulverized. The pulverization is carried out as in a ball mill, for example. The powder obtained by the pulverization is desired to have a particle size distribution such that the particles passing the 150-mesh Tyler sieve make up more than 90% of the whole powder.

The pulverization may be performed on the two components either separately of each other or after they have been mixed with each other. When, they are pulverized separately, the two separate powders to be obtained are mixed after the pulverization. Where there is used iron ore, the mixing ratio is desired to be such that the amount of carbonaceous material to be mixed ranges from 0.6 to 1.3 times the theoretical value to be calculated from the following expression involving FeO or $Fe_2O_3$ contained in the ore:

$$FeO + C \rightarrow Fe + CO$$

$$Fe_2O_3 + 3C \rightarrow 2Fe + 3CO$$

This range represents the limits of the ordinary extent of reduction to be effected when the roasting for the production of reduced pellets is performed in a rotary kiln. Thus, said mixing ratio can be selected suitably from within this range.

In the case of chromium ore and manganese ore, their reactions for reduction can occur in various forms. Typical reactions are as follows.

Where chromium ore is used as the raw material:

$$7Cr_2O_3 + 27C \rightarrow 2Cr_7C_3 + 21CO$$

$$7FeO + 10C \rightarrow Fe_7C_3 + CO$$

Where manganese ore is used as the raw material:

$$7Mn_2O_3 + 27C \rightarrow 27Mn_7C_3 + 21CO$$

$$7FeO + 10C \rightarrow Fe_7C_3 + CO$$

In the actual production of reduced pellets, the suitable amount of carbonaceous material to be mixed is 0.6 to 1.3 times the theoretical amount of carbon calculated from the relevant formula given above. This range is fixed by taking into account a certain loss possibly incurred in the course of roasting. Of course, the value thereof is variable more or less with the percentage of reduction desired to be obtained in the particular operation.

The term "percentage of reduction" as used herein means the proportion (in %) of the oxygen atoms to be removed by the reductive roasting treatment to all the oxygen atoms which are coupled with the metal atoms present in the mineral ore in use.

In the case of chromium ore, for example, iron and chromium which are metals are generally present therein in the form of FeO and $Cr_2O_3$ respectively. In this case, the percentage of reduction is calculated as follows:

$$\text{Percentage of reduction} = \frac{\text{Amount of oxygen removed}}{\text{Total amount of oxygen present}} = \frac{\frac{\text{Red Cr \%}}{52.01} \times \frac{3}{2} + \frac{\text{Red Fe \%}}{55.85}}{\frac{\text{Total Cr \%}}{52.01} + \frac{3}{2} + \frac{\text{Total Fe \%}}{55.85}} \times 100$$

wherein, Total Cr% stands for the total amount of chromium present in the chromium ore being roasted for reduction, Total Fe% for the total amount of iron present in said ore, Red Cr% for the amount of chromium reduced in the roasting and Red Fe% for the amount of iron reduced in the roasting respectively.

In actuality, with $Cr_2O_3$ or $Mn_2O_3$ it is difficult to effect the reduction to any extent over the level of 80%. If the amount of the carbonaceous substance present in the reduced pellets is excessive, there are incurred various troubles. For example, the pellets themselves suffer from deficient strength so that they are readily disintegrated while they are being burnt, transported or poured into an electric furnace. Presence of excess carbon in the reduced pellets is not desirable. A deficient carbon content, on the other hand, results in a decline in the percentage of reduction. Thus, the amount of the heat-treated anthracite to be mixed with the mineral ore is limited to the range mentioned above.

The mixture of the powders of mineral ore and carbonaceous reducing material obtained as described above is then added bentonite, starch etc. as binder. This pelletization carried out as by use of a pan pelletizer or drum pelletizer in the presence of water. The suitable pellet size is approximately from 10 to 30mm in diameter.

The green pellets thus obtained are then subjected to reductive roasting. A rotary kiln, a shaft kiln or some other similar device may be used for the roasting of the green pellets. It is particularly desirable that the pellets be placed under a slightly oxidative atmosphere in a rotary kiln and roasted as rolled within the rotating kiln barrel to the extent of causing combustion on a small portion of the carbonaceous reducing material present in the pellets. By this roasting, the surface of the pellets is coated with a tenacious film which is formed of the metal oxide originally present in the mineral ore. This film serves as a protective coat for the reduced metal carbide held underneath. The reduced pellets, if exposed to the air, are readily re-oxidized. If it were not for this film originating in the metal oxide, then the reduced pellets would undergo violet re-oxidation up-on contacting with but a small amount of air while they are in storage before treatment in the electric furnace, whereas there incur various troubles such as cohesion of individual pellets, for example. The film of the metal oxide, however, provides them with a protective coat capable of precluding such troubles.

When the roasting temperature is too low the pellets are not sufficiently reduced and when too high the pellets are likely to adhere to each other. Roasting temperature between 1200° C. and 1500° C are most appropriate.

With a view to thermal efficiency, it is desirable that the reduced pellets be placed in the electric furnace immediately after their production, vis. without being left long enough to cool off. The electric furnace charged with the reduced pellets is desired to be operated by means of a submerged arc.

The following working examples are further illustrative of the present invention. It should be understood that this invention is not limited to these examples.

EXAMPLE 1

A powdered carbonaceous substance having a particle size distribution such that the particles passing the 150-mesh Tyler sieve made up more than 90% was prepared by treating anthracite of the properties indicated in Table 1 under the heating "Anthracite A" in a rotary kiln at temperatures between 600° C and 1000° C for 80 minutes. With 16 parts by weight of this powdered carbonaceous substance were admixed 100 parts by weight of powdered chromium ore having a particle size distribution such that the particles passing the 150-mesh Tyler sieve made up more than 90% and showing the composition indicated below and 3% of bentonite of the composition indicated below and 13% of water based on the mixed weight of said carbonaceous substance and mineral ore. The resultant mixture was pelletized by a pan type pelletizer to produce green pellets having an average particle diameter of 20mm.

| | $Cr_2O_3$ | FeO | $Al_2O_3$ | $SiO_2$ | MgO |
|---|---|---|---|---|---|
| Powdered chromium ore | 44.6 | 25.5 | 14.3 | 3.3 | 11.0 |
| | $SiO_2$ | $Al_2O_3$ | FeO | MgO | CaO |
| Bentonite | 62.5 | 12.1 | 2.3 | 3.0 | 2.2 |

The green pellets were dried in a draft dryer and then heated in a rotary kiln for two hours, with the combustion zone controlled at temperatures in the range of from 1200° to 1450° C to produce reduced pellets.

Separately, the coke from coal and the anthracite A both indicated in Table 1 were pulverized each to a particle size distribution such that the particles passing the 90-mesh Tyler sieve made up more than 90%. Green pellets were produced by subjecting these powdered products to entirely the same procedure as described above. The green pellets were then roasted under entirely the same conditions to afford reduced pellets.

The reduced pellets obtained as described above were tested for sintered strength, powder ratio and percentage of reduction. The results were as shown below.

| Carbonaceous substance | Sintered strength | Powder ratio | Percentage of reduction |
|---|---|---|---|
| Anthracite A treated in rotary kiln | 92kg | 3% | 65% |
| Anthracite A | 71 | 22 | 52 |
| Coke from coal | 96 | 3 | 66 |

The term "sintered strength" means the magnitude of pressure required to cause disintegration on a given reduced pellet cooled to normal room temperature. The term "powder ratio" means the ratio (in % by weight) of the amount of reduced pellets allowed to pass through a sieve of 4-mm mesh to the total amount of reduced pellets in a given sample.

The table given above clearly indicates that the reduced pellets produced by the method of the present invention possess entirely the same degrees of sintered strength, powder ratio and percentage of reduction as those of the reduced pellets manufactured by using coke from coal as the carbonaceous substance. Moreover, with respect to various properties indicated in Table 3, these reduced pellets retain the advantageous properties possessed by anthracite Ferrochrome was manufactured by charging an electric furnace with these reduced pellets. To be more specific, an electric furnace rated for 18000 KVA 3-phase was charged with 1000 parts of the reduced pellets, 80 parts of coke, 60 parts of silica stone and 100 parts of limestone. The metal obtained by the refining was analyzed. The analysis was as shown below.

| Cr | C | S | S | Fe |
|---|---|---|---|---|
| 55.7 wt % | 8.32 wt % | 1.3 wt % | 0.02 wt % | Balance |

The consumption of electric power involved in this refining operation was 1920 KWH/ton of ferrochrome.

EXAMPLE 2

Powdered mixtures were prepared by faithfully following the procedure of Example 1 except that substances indicated in the following table were used as carbonaceous substances. They were treated by a drum type pelletizer to afford green pellets 20mm in diameter. The green pellets thus obtained were tested for hot strength. The results were as shown in the following table.

| No. | Carbonaceous substance | Hot strength (kg/pellet) 100 C | 600 C | 900 C | 1200 C |
|---|---|---|---|---|---|
| 1 | Powdered coke | 18 | 26 | 52 | 85 |
| 2 | Anthracite A as given in Table 1 | 21 | 18 | 13 | 61 |
| 3 | Substance obtained by heating Anthracite A in a muffle furnace at 400 C for 90 minutes | 23 | 25 | 20 | 58 |
| 4 | Substance obtained by heating Anthracite A in a muffle furnace at 600 C for 90 minutes | 20 | 27 | 48 | 82 |
| 5 | Substance obtained by heating Anthracite A in a muffle furnace at 1000 C for 90 minutes | 19 | 23 | 51 | 88 |
| 6 | Substance obtained by heating Anthracite A in a muffle furnace at 1200 C for 90 minutes | 20 | 25 | 55 | 84 |

The hot strength was measured as follows: In a vertical cylindrical furnace capable of regulating the inner atmosphere and provided with a receptacle attached to the head of an automatic elevating rod disposed at the center, a reduced pellet given as a sample was mounted on said receptacle, heated under argon gas to gradually elevated temperatures and held at the prescribed temperature for 30 minutes. A bar connected directly to a load cell was disposed 30mm above the receptacle. The magnitude of pressure required to cause disintegration on the sample reduced pellet as held at the elevated temperature was measured by allowing the automatic elevating rod to rise so as to press the sample against the upper bar.

In the preceding table, No. 3 and No. 4 represent the products obtained in accordance with the method of the present invention. The values of hot strength found for these products are noted to excel those found for No. 2, No. 5 and No. 6 and to equal the value found for the product from powdered coke.

What is claimed is:

1. In a method for the manufacture of reduced pellets by mixing a powdered mineral ore with anthracite, pelletizing the resultant mixture with a binder added thereto and subsequently roasting the formed pellets, an improvement characterized by heating said anthracite to a temperature between 600° C and 1,000° C, pulverizing said heat-treated anthracite and then forming pellets which comprise said powdered mineral ore, said anthracite and said binder.

2. The improved method of claim 1, wherein the calcined anthracite has a fuel ratio of from 4 to 10.

3. The improved method of claim 1, wherein the amount of the calcined anthracite to be used with an iron ore is 0.6 to 1.3 times the theoretical amount required for reducing the iron oxide present in the ore to metallic iron.

4. The improved method of claim 1, wherein the amount of the calcined anthracite to be used with a manganese ore is 0.6 to 1.3 times the theoretical amount required for reducing the manganese oxide and iron oxide present in the ore respectively into Mn C and Fe C .

5. The improved method of claim 1, wherein the amount of the calcined anthracite to be used with a chromium ore is 0.6 to 1.3 times the theoretical amount required for reducing the chromium oxide and iron oxide present in the ore respectively into Cr C and Fe C .

* * * * *